US009901157B2

(12) United States Patent
Yiu

(10) Patent No.: US 9,901,157 B2
(45) Date of Patent: Feb. 27, 2018

(54) NAIL CARE DEVICE

(71) Applicant: SOFT LINES INTERNATIONAL, LTD., Kowloon (HK)

(72) Inventor: Wai Wah Yiu, Kowloon (HK)

(73) Assignee: SOFT LINES INTERNATIONAL, LTD., Hong Kong (HK)

( * ) Notice: Subject to any disclaimer, the term of this patent is extended or adjusted under 35 U.S.C. 154(b) by 0 days.

(21) Appl. No.: 14/823,723

(22) Filed: Aug. 11, 2015

(65) Prior Publication Data

US 2017/0042306 A1 Feb. 16, 2017

(51) Int. Cl.
*A45D 29/05* (2006.01)

(52) U.S. Cl.
CPC ..... *A45D 29/05* (2013.01)

(58) Field of Classification Search
CPC ..... A61B 2017/32004; A61B 2017/54; A45D 29/00; A45D 29/007; A45D 29/04; A45D 29/05; A45D 29/06; A45D 29/11; A45D 29/14; A45D 29/17; A45D 29/045; A45D 34/041; A45D 2200/1054; A45D 2200/1063; A24D 9/00
See application file for complete search history.

(56) References Cited

U.S. PATENT DOCUMENTS 1,869,197 A * 7/1932 Holz ..... A61B 17/54 132/75.8
1,915,305 A * 6/1933 Gallagher ..... A45D 29/14 132/75.8
2,056,379 A * 10/1936 Acocella ..... A45D 29/14 132/73.6
2,395,296 A * 2/1946 Schwab ..... B26B 19/30 30/41.6
4,103,694 A 8/1978 Burian et al.
4,117,854 A * 10/1978 Rosenbloom ..... A45D 29/05 132/75.8
4,753,253 A 6/1988 Hutson
5,123,430 A 6/1992 Davidovitz
5,161,552 A * 11/1992 Kathuria ..... A45D 29/05 132/73.6
5,377,699 A * 1/1995 Varnum ..... A45D 26/0004 132/289

(Continued)

FOREIGN PATENT DOCUMENTS

CH 581454 11/1976
CN 2794280 7/2006

(Continued)

OTHER PUBLICATIONS

Extended European Search Report for EP Application No. 15191805.9, dated Jun. 10, 2016, 12 pages.

(Continued)

*Primary Examiner* — Rachel Steitz
(74) *Attorney, Agent, or Firm* — Foley & Lardner LLP

(57) ABSTRACT

A nail care device includes a housing defining a slot extending through the housing and to a cavity; a drive mechanism disposed within the housing and including a drive member extending into the cavity; and a drum assembly configured to be removably engaged with the drive member, the drum assembly including an abrasive drum configured to be received within the cavity and a hub configured to extend to an exterior of the cavity and the housing.

17 Claims, 8 Drawing Sheets

(56) References Cited

U.S. PATENT DOCUMENTS

| | | | | |
|---|---|---|---|---|
| 5,762,077 | A | 6/1998 | Griffiths, Jr. | |
| D405,232 | S | 2/1999 | Stevens et al. | |
| 6,050,270 | A | 4/2000 | Tyshenko, Jr. | |
| 6,442,840 | B2 * | 9/2002 | Zucker | 30/34.2 |
| 6,523,546 | B2 * | 2/2003 | Jo | A61B 17/54 132/75 |
| 7,428,881 | B2 * | 9/2008 | Drelinger | A45D 29/05 119/608 |
| D600,413 | S | 9/2009 | Khubani | |
| D603,561 | S | 11/2009 | Cho | |
| D678,614 | S | 3/2013 | Yiu | |
| D681,277 | S | 4/2013 | Yiu | |
| D686,370 | S | 7/2013 | Yiu | |
| D692,181 | S | 10/2013 | Yiu | |
| 8,545,516 | B1 * | 10/2013 | Winnett | A61B 17/54 606/131 |
| 8,551,117 | B2 * | 10/2013 | Yiu | A61B 17/54 30/43.5 |
| D709,650 | S | 7/2014 | Yiu | |
| D726,372 | S | 4/2015 | Yiu | |
| D736,999 | S | 8/2015 | Yiu | |
| D737,517 | S | 8/2015 | Yiu | |
| D737,518 | S | 8/2015 | Yiu | |
| D737,519 | S | 8/2015 | Yiu | |
| D737,520 | S | 8/2015 | Yiu | |
| D738,043 | S | 9/2015 | Yiu | |
| D739,080 | S | 9/2015 | Yiu | |
| D751,253 | S | 3/2016 | Hollinger | |
| D751,762 | S | 3/2016 | Hollinger | |
| D752,812 | S | 3/2016 | Sivan | |
| D756,034 | S | 5/2016 | Yiu | |
| D759,311 | S | 6/2016 | Khubani | |
| D765,914 | S | 9/2016 | Khubani | |
| D766,508 | S | 9/2016 | Wang et al. | |
| D768,931 | S | 10/2016 | Langberg et al. | |
| D769,529 | S | 10/2016 | Langberg et al. | |
| 2002/0050278 | A1 | 5/2002 | Jo et al. | |
| 2002/0107527 | A1 * | 8/2002 | Burres | A45D 29/14 606/131 |
| 2003/0102002 | A1 | 6/2003 | Cho | |
| 2006/0137703 | A1 | 6/2006 | Kling | |
| 2006/0150992 | A1 * | 7/2006 | Nevakshonoff | B24B 23/02 132/73.6 |
| 2006/0180170 | A1 | 8/2006 | Merten | |
| 2006/0260629 | A1 | 11/2006 | Chern | |
| 2006/0272664 | A1 | 12/2006 | O'Dwyer | |
| 2009/0126750 | A1 * | 5/2009 | Pellereau | A45D 29/04 132/76.4 |
| 2010/0083975 | A1 | 4/2010 | Nguyen et al. | |
| 2010/0236565 | A1 | 9/2010 | Fernandez et al. | |
| 2011/0226268 | A1 | 9/2011 | Filonczuk | |
| 2011/0226269 | A1 | 9/2011 | Routhier et al. | |
| 2011/0226270 | A1 * | 9/2011 | Rivera | A45D 29/05 132/73.6 |
| 2013/0081645 | A1 | 4/2013 | Caviness | |
| 2013/0092182 | A1 | 4/2013 | Stockbauer | |
| 2015/0150352 | A1 | 6/2015 | Yiu | |
| 2015/0173484 | A1 | 6/2015 | Fitzsimons et al. | |
| 2015/0201969 | A1 | 7/2015 | Dugo et al. | |
| 2016/0295988 | A1 | 10/2016 | Yiu | |

FOREIGN PATENT DOCUMENTS

| | | | | |
|---|---|---|---|---|
| CN | 2930405 | | 8/2007 | |
| CN | 201230701 | | 5/2009 | |
| CN | 102958461 | | 3/2013 | |
| CN | 203353904 | | 12/2013 | |
| CN | 203505864 | U | 4/2014 | |
| CN | 204949898 | | 1/2016 | |
| DE | 86 10 993 | | 8/1986 | |
| DE | 20 2014 103 411 | | 10/2014 | |
| DE | 21 2014 000 041 | | 11/2015 | |
| GB | 2191396 | A * | 12/1987 | A45D 29/05 |
| JP | S50-040476 | | 4/1975 | |
| JP | S51-132178 | | 10/1976 | |
| JP | S59-141902 | | 8/1984 | |
| JP | H04-044808 | | 4/1992 | |
| JP | H06-169812 | | 6/1994 | |
| JP | H06-277113 | | 10/1994 | |
| JP | 2014-506821 | A | 3/2014 | |
| WO | WO-02/28296 | | 4/2002 | |
| WO | WO-2012/120373 | | 9/2012 | |

OTHER PUBLICATIONS

International Search Report and Written Opinion for PCT Application No. PCT/IB2015/056121, dated May 6, 2016, 12 pages.

Pursonic NC1 Electric Nail Trimmer, www.amazon.com, 1 page, downloaded Oct. 29, 2016.

Communication pursuant to Article 94(3) EPC for EP Application No. 15191805.9, dated Jul. 5, 2017, 15 pages.

* cited by examiner

NAIL CARE DEVICE

BACKGROUND

The present disclosure relates generally to the field of cosmetic devices, and more specifically, to the field of nail care devices, such as nail trimmers and similar devices used to trim, file, smooth, and/or polish, etc. nails, skin, etc. of a user.

SUMMARY

One embodiment relates to a nail care device, including a housing defining a slot extending through the housing and to a cavity; a drive mechanism disposed within the housing and including a drive member extending into the cavity; and a drum assembly configured to be removably engaged with the drive member, the drum assembly including an abrasive drum configured to be received within the cavity and a hub configured to extend to an exterior of the cavity and the housing.

Another embodiment relates to a portable nail care device configured for cordless handheld use, the nail care device including a housing including a housing wall defining an upper cylindrical exterior surface having a slot disposed therein; and an interior, the interior including a lower cavity and an upper cavity; a motor disposed in the lower cavity and coupled to a drive shaft extending into the upper cavity; a drum assembly configured to be removably coupled to the drive shaft in the upper cavity, the drum assembly including a cylindrical drum including an abrasive outer surface and defining a longitudinal axis; wherein the slot extends in a direction parallel to the longitudinal axis.

Another embodiment relates to a portable nail care device configured for cordless handheld use, the nail care device including a housing including a housing wall defining an upper cylindrical exterior surface having a slot disposed therein; a lower exterior surface configured to held in the hand of a user; and an interior, the interior including a lower cavity and an upper cavity; a motor disposed in the lower cavity and coupled to a drive shaft extending into the upper cavity; a drum assembly configured to be removably coupled to the drive shaft in the upper cavity, the drum assembly including a compressible cylindrical drum including an abrasive outer surface and defining a longitudinal axis; and a hub assembly disposed at a first end of the cylindrical drum and extending beyond the housing wall to accessible by a user to remove the cylindrical drum in a lateral direction along the longitudinal axis; wherein the slot extends in a direction parallel to the longitudinal axis; and wherein the hub assembly remains fixed relative to the housing when the cylindrical drum is rotated by the drive shaft.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION

This application will become more fully understood from the following detailed description, taken in conjunction with the accompanying figures, wherein like reference numerals refer to like elements.

Figure 1:
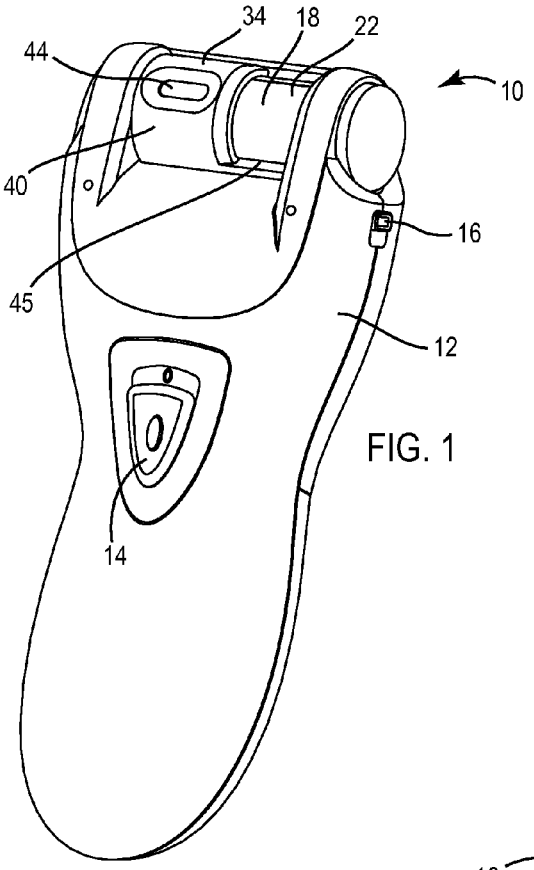
FIG. 1 is a front perspective view of a nail care device according to one embodiment.
Figure 13:
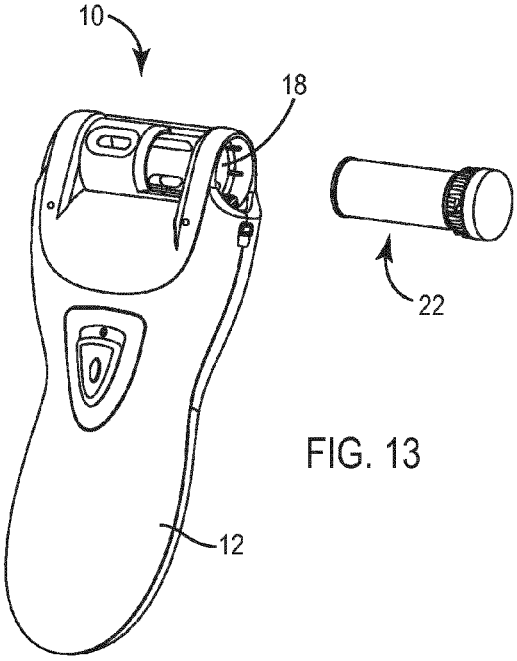

FIG. 13 a perspective view of a drum assembly removed from the nail care device of FIG. 1 according to one embodiment.

Figure 14:
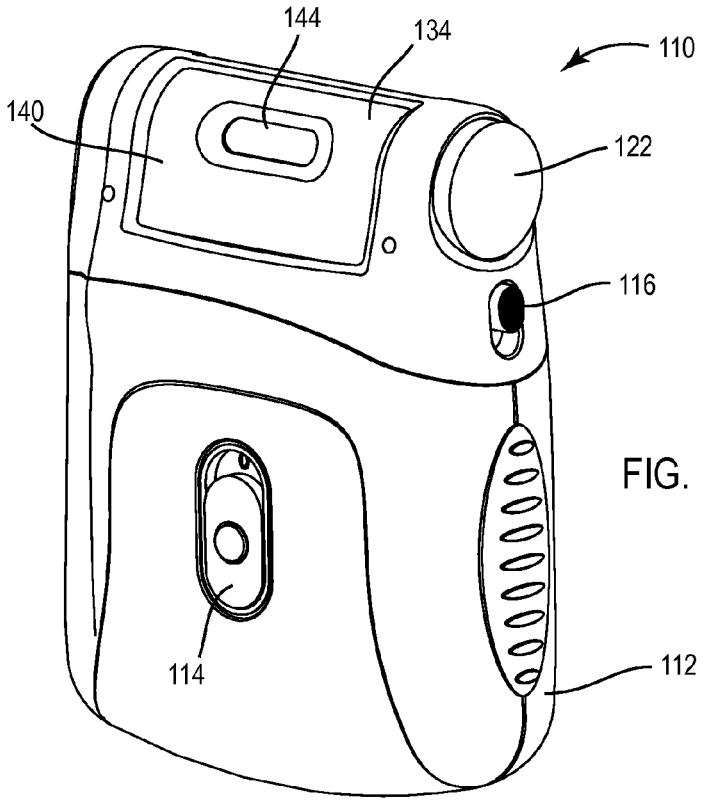

FIG. 14 is a perspective view of a nail care device according to an alternative embodiment.

Figure 15:
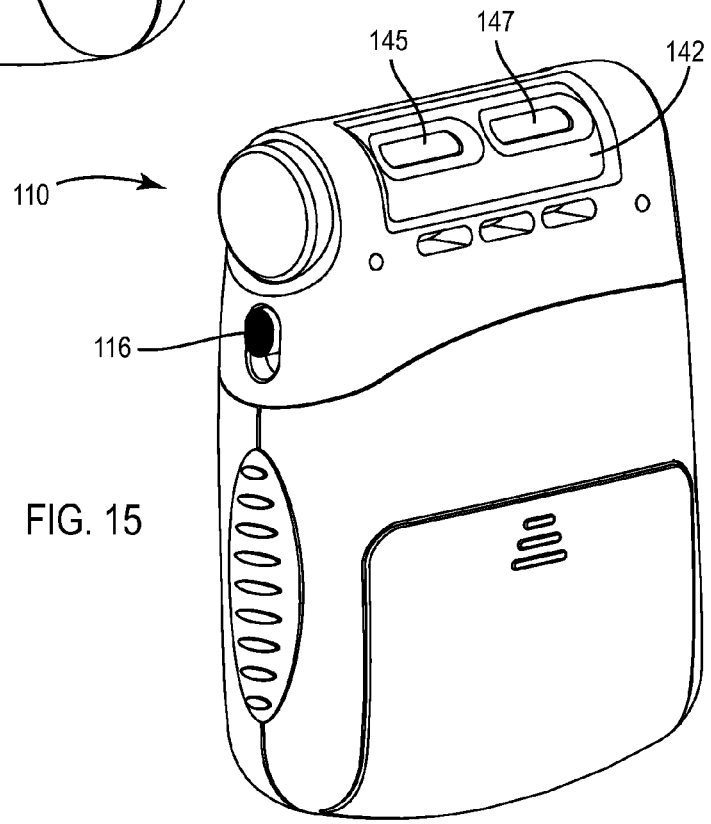

FIG. 15 is a rear perspective view of the nail care device of FIG. 14 according to one embodiment.

Figure 16:
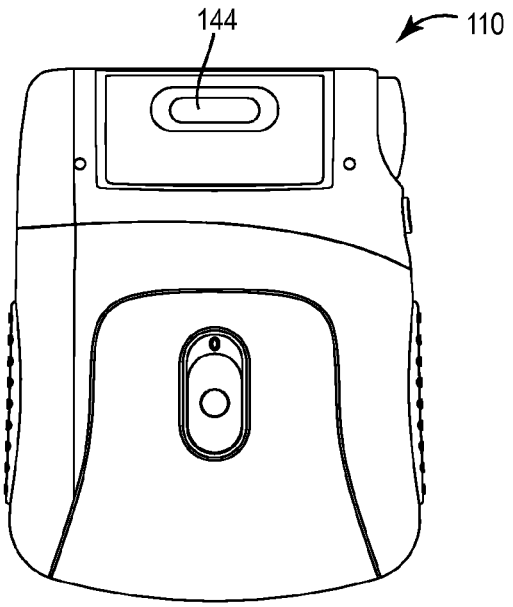

FIG. 16 is a front view of the nail care device of FIG. 14 according to one embodiment.

Figure 17:
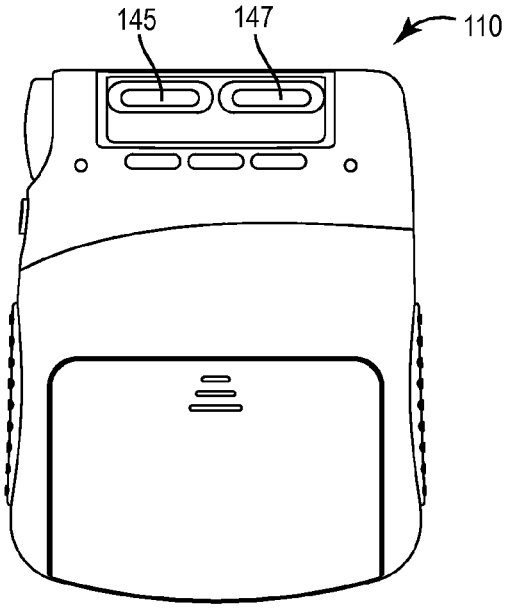

FIG. 17 is a rear view of the nail care device of FIG. 14 according to one embodiment.

Figure 18:
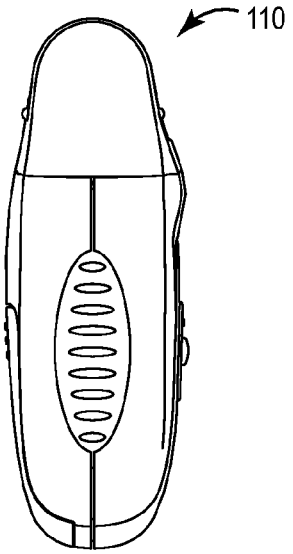

FIG. 18 is a left side view of the nail care device of FIG. 14 according to one embodiment.

Figure 19:
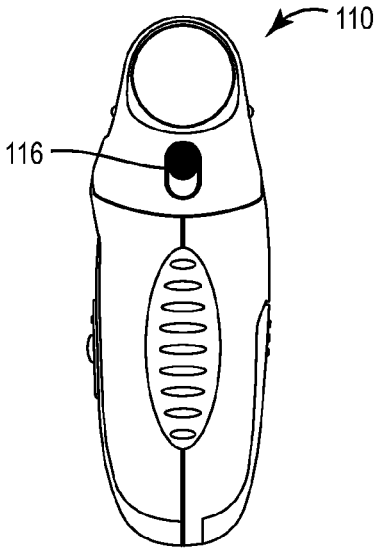

FIG. 19 is a right side view of the nail care device of FIG. 14 according to one embodiment.

Figure 20:
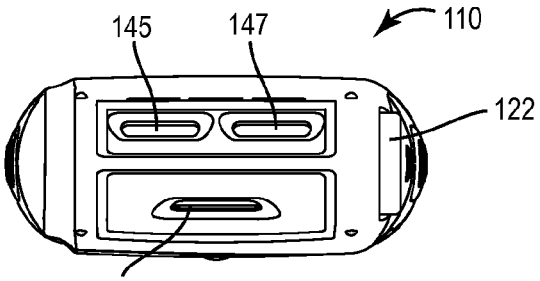

FIG. 20 is a top view of the nail care device of FIG. 14 according to one embodiment.

Figure 21:
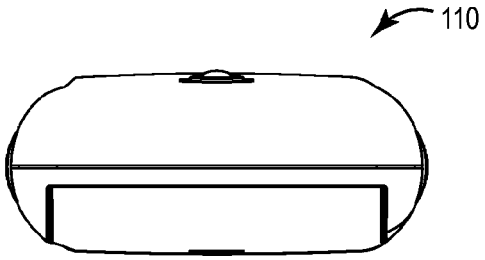

FIG. 21 is a bottom view of the nail care device of FIG. 14 according to one embodiment.

Figure 22:
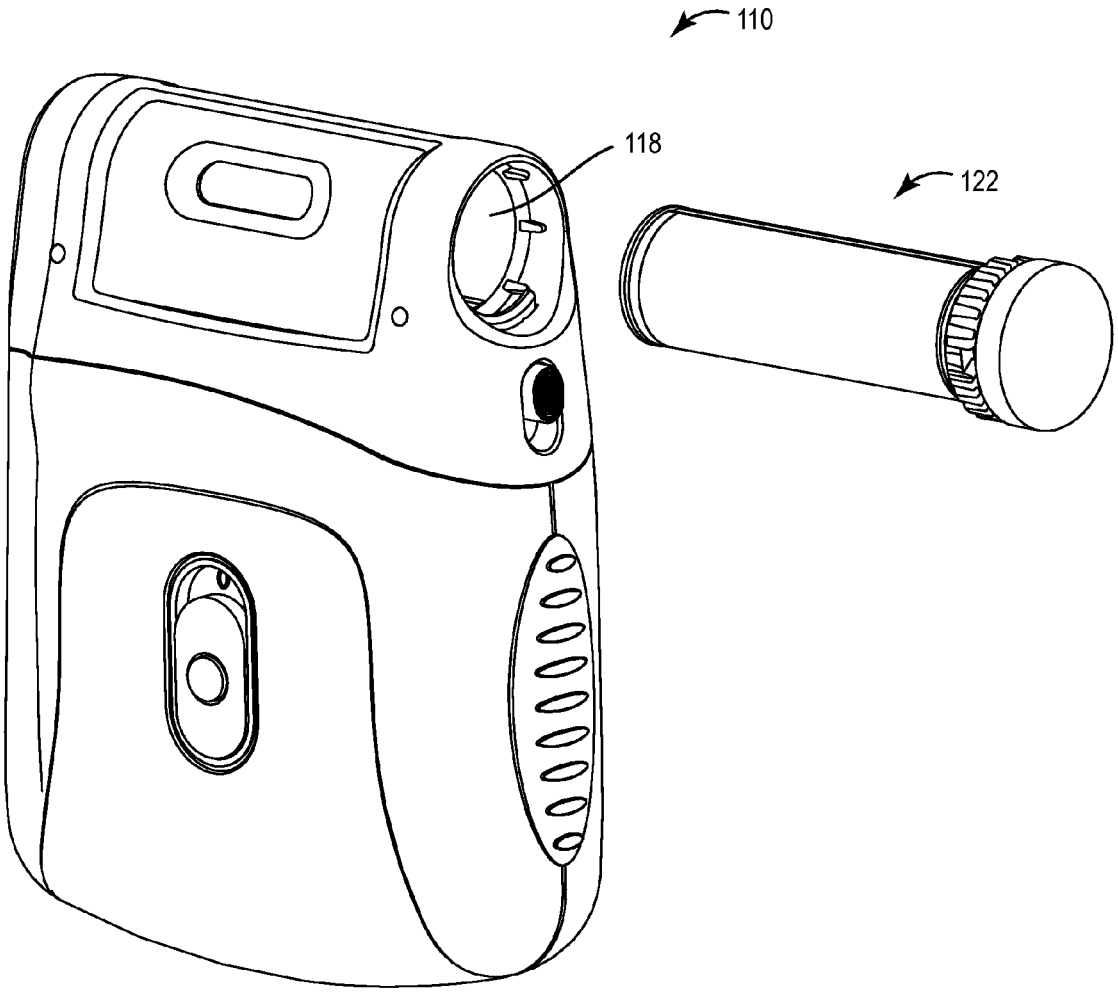

FIG. 22 a perspective view of a drum assembly removed from the nail care device of FIG. 14 according to one embodiment.

DETAILED DESCRIPTION

Before turning to the Figures, which illustrate the exemplary embodiments in detail, it should be understood that the present application is not limited to the details or methodology set forth in the description or illustrated in the Figures. It should also be understood that the terminology used herein is for the purpose of description and illustration only, and should not be regarded as limiting.

Referring to the Figures generally, various embodiments disclosed herein are directed to a nail care device usable to trim, shape, smooth, polish, or otherwise care for nails. It should be noted, however, that in some embodiments the devices disclosed herein may be usable as a skin care device to abrade, smooth, or otherwise care for skin. Generally, a portable, handheld device includes a rotating drum assembly having an abrasive outer surface. Engagement of the rotating outer abrasive surface of the drum assembly with nails, skin, etc. enables a user to remove, smooth, polish, etc. a surface of a nail and/or skin as desired. In some embodiments, the rotating drum assembly includes a compressible drum to provide for enhanced smoothing, shaping, and/or other capabilities. Further, the rotating drum assembly may be configured with differing levels of abrasiveness, compressibility/harness, etc., which may be in turn identified by using different colors or other identifiers.

Referring now to FIGS. 1-13, a nail care device 10 is shown according to one embodiment. Device 10 may be configured for various cosmetic treatments or procedures involving removal of nail material, including nail trimming, polishing, buffing, shining, smoothing, and the like. In other embodiments, device 10 is usable on the skin of a user. All such applications are within the scope of the present disclosure. As shown in the FIGS. 1-8, device 10 is a portable, handheld device that utilizes an electromechanical drive system (e.g., an electric motor in combination with an appropriate gear train, drive shaft, power source or battery, etc.). In various alternative embodiments, device 10 may be configured for corded and/or cordless use.

Figure 10:
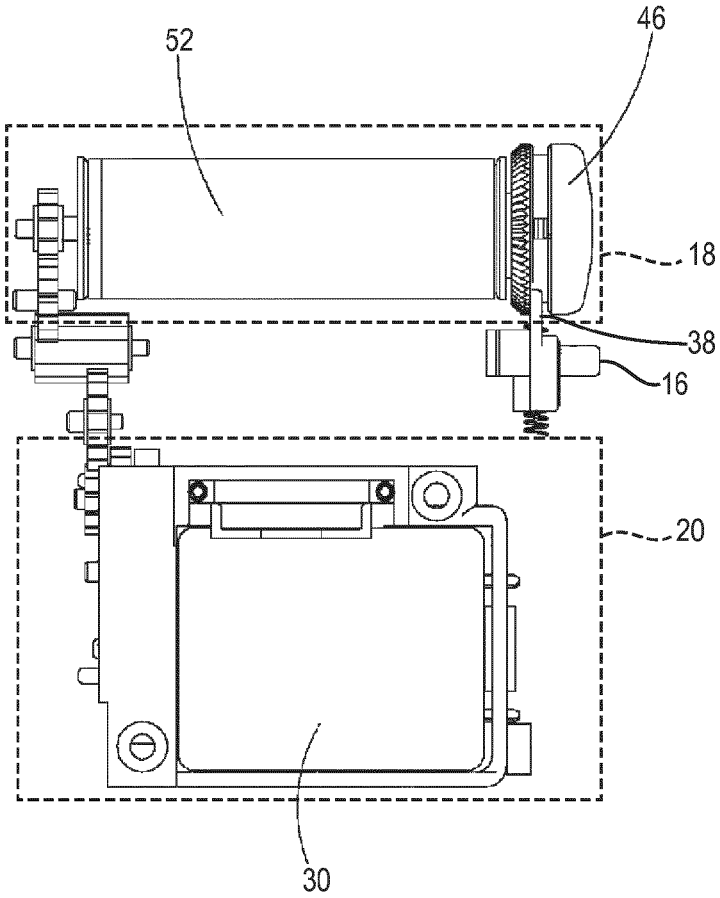
FIG. 10 is a front view of a drive system for the nail care device of FIG. 1 according to one embodiment.

In one embodiment, device 10 includes a housing 12 defining an upper cavity 18 and a lower cavity 20 (see, e.g., FIG. 10). Cavities 18, 20 form at least a portion of the interior of housing 12 and receive various components of device 10, such as drum assemblies, drive system components, and the like. A power switch 14 may be disposed on (e.g., slidably coupled to, etc.) an outer surface of housing 12 and be usable to turn device 10 on/off. A release button 16 is provided on a side of housing 12 and is usable to release a drum assembly 22 from within upper cavity 18, as discussed in greater detail below. Housing 18 may include a battery cover 36 removable to provide access to a battery. Housing 18 may be contoured to comfortably fit in the hand of a user during use and enable easy manipulation of the device. In various alternative embodiments, including the embodiment of FIGS. 14-22, the size and shape of housing 12 may be varied to suit a particular application (e.g., different-sized hands, etc.).

Figure 2:
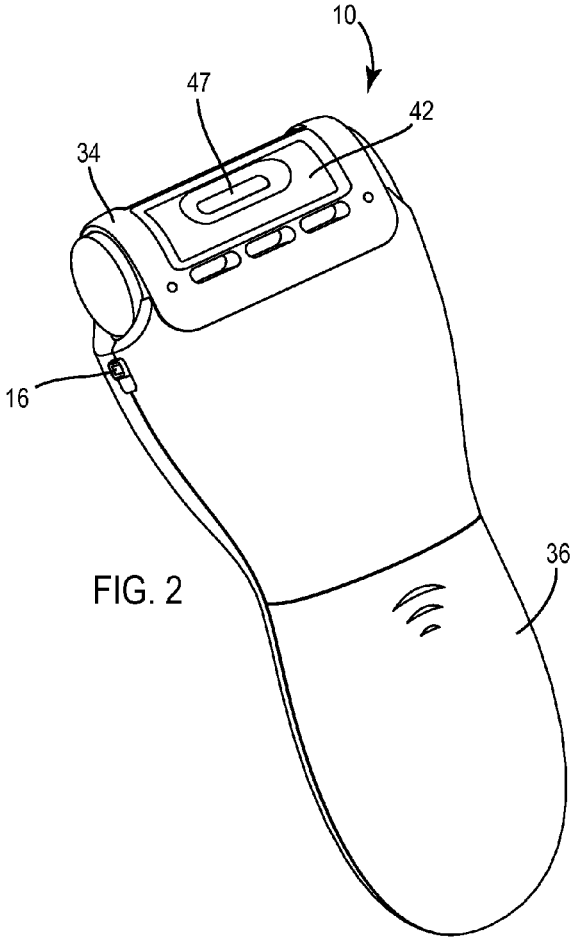
FIG. 2 is a rear perspective view of the nail care device of FIG. 1 according to one embodiment.
Figure 3:
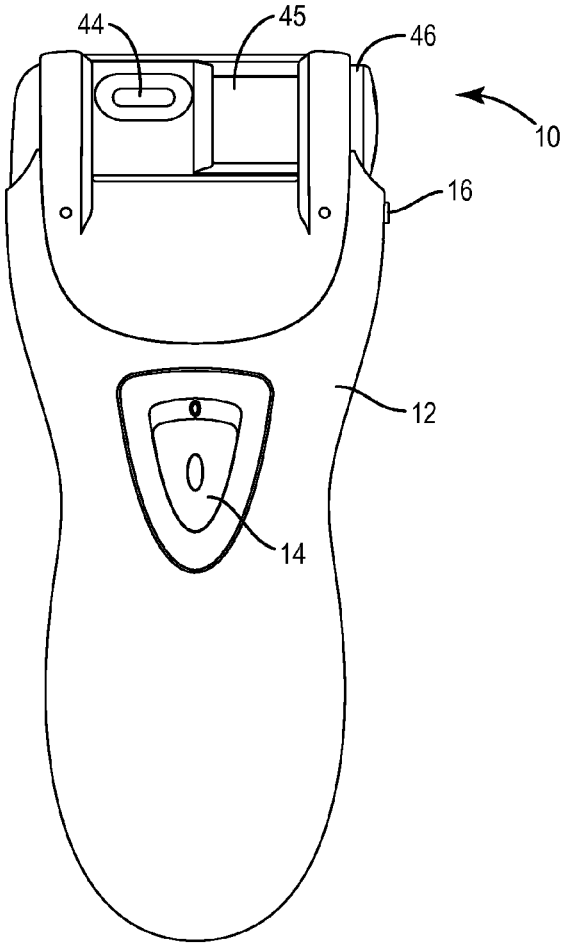
FIG. 3 is a front view of the nail care device of FIG. 1 according to one embodiment.
Figure 4:
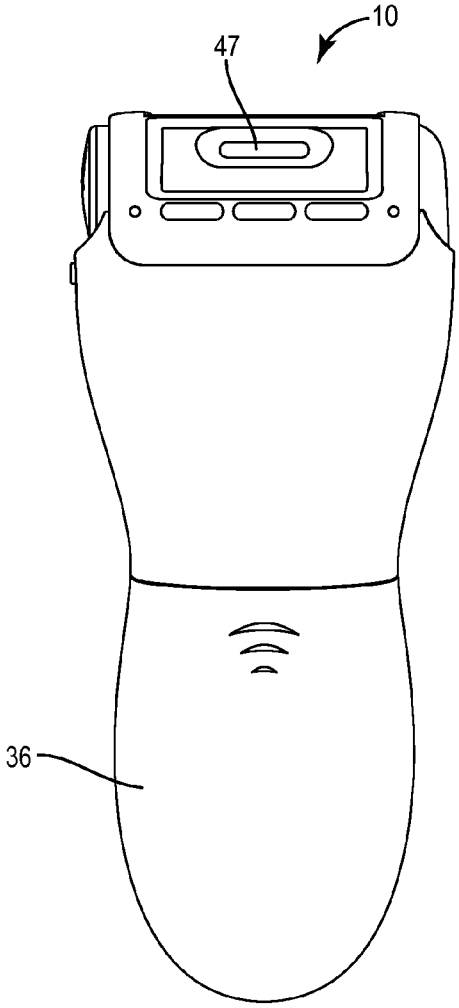
FIG. 4 is a rear view of the nail care device of FIG. 1 according to one embodiment.
Figure 5:
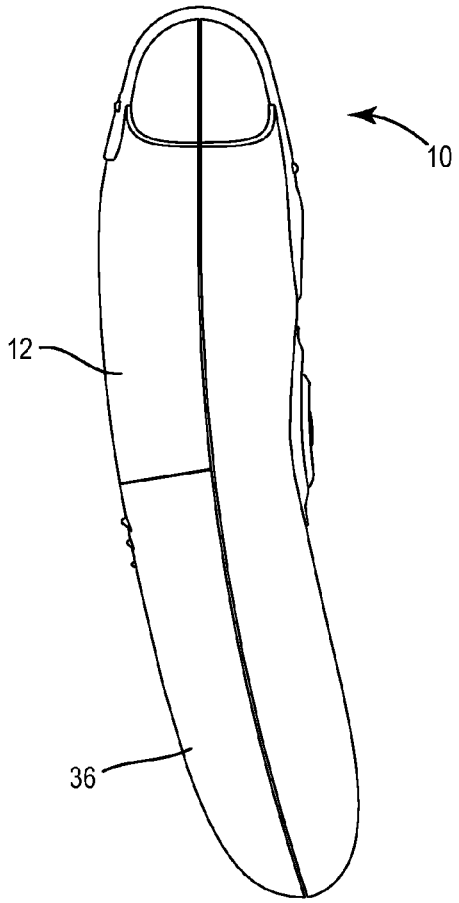
FIG. 5 is a left side view of the nail care device of FIG. 1 according to one embodiment.
Figure 6:
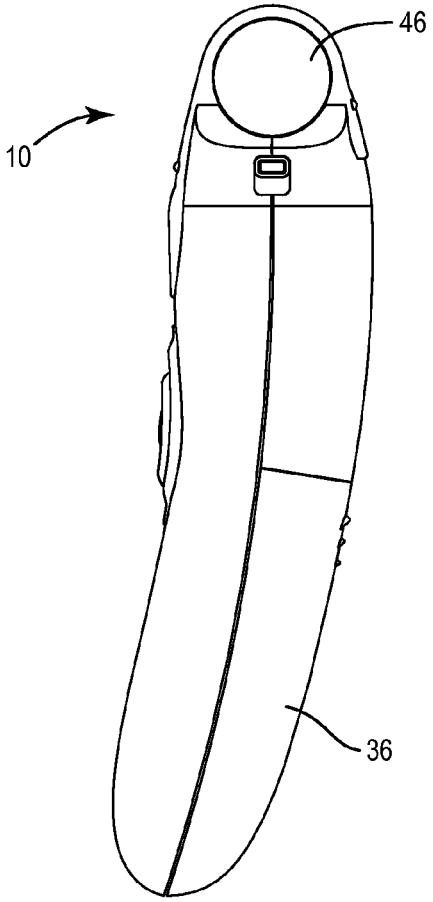
FIG. 6 is a right side view of the nail care device of FIG. 1 according to one embodiment.
Figure 7:
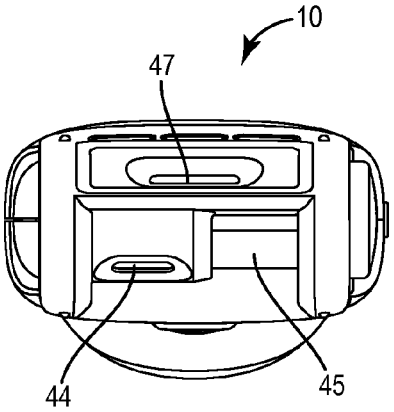
FIG. 7 is a top view of the nail care device of FIG. 1 according to one embodiment.

Housing 12 further includes a drum assembly cover 34 configured to cover one or more portions of drum assembly 22. In various embodiments, cover 34 includes one or more slots intended to enable a user to care for nails, skin, etc. by utilizing drum assembly 22. For example, in one embodiment, cover 34 forms one or more generally cylindrically-shaped portions that conform to the shape of drum assembly 22, and defines one or more slots 44, 45, 47. As shown in FIGS. 1-2, cover 34 includes a first side 40 (e.g., a front cylindrical portion, etc.) defining slots 44, 45 and a second side 42 (e.g., a rear cylindrical portion, etc.) defining slot 47. Slots 44, 45, and 47 extend from the exterior of the device to upper cavity 18 such that a nail, a portion of skin, etc., can pass through the slots and engage drum assembly 22.

As shown in FIG. 1, slot 44 is a generally elongated, at least partially oval-shaped slot extending longitudinally relative to the longitudinal axis of drum assembly 22 for a portion of the length of drum assembly 22 (e.g., one-fourth, one-third, one-half, etc. of the length of drum assembly 22, or drum 52). Slot 44 may be configured to receive an end portion of a nail of a user, and trim, file, smooth, polish, etc. the nail, without the surrounding skin being abraded by roller assembly 22. In one embodiment slot 44 is surrounded by a beveled portion of cover 34 intended to facilitate resting a finger adjacent slot 44 while a corresponding nail engages drum assembly 22.

Referring further to FIG. 1, slot 45 is shown to be substantially wider than slot 44. In one embodiment, slot 45 extends circumferentially about drum assembly for at least about 90 degrees, at least about 120 degrees, or at least about 150 degrees. For example, as shown in FIG. 1, at least one-fourth (i.e., 90 degrees) of the circumferential area of roller assembly 22 is exposed for the length of slot 45. Providing slot 45 having a substantially greater width than slot 44 enables, among other things, contouring of nails, shaping of surrounding skin, and a larger surface area of drum assembly 22 with which to work.

Referring to FIG. 2, slot 47 is a generally elongated, oval slot extending longitudinally relative to the longitudinal axis of drum assembly 22 for a portion of the length of drum assembly 22 (e.g., one-fourth, one-third, one-half, etc. of the length of drum assembly 22, or drum 52). Slot 47 may be configured to receive an end portion of a nail of a user, and trim, file, smooth, polish, etc. the nail, without the surrounding skin being abraded by drum assembly 22. In one embodiment slot 47 is surrounded by a beveled portion of cover 34 intended to facilitate resting a finger adjacent slot 47 while a corresponding nail engages drum assembly 22.

In one embodiment, slot 47 is generally equal in size and shape to slot 44. In other embodiments, slot 47 differs from slot 44 in size and/or shape (e.g., having a different length and/or width, being rectangular in shape, etc.). In FIGS. 1-2, slot 47 is shown as being longer than slot 44. In some embodiments, slot 47 is positioned longitudinally along cover 34 approximately between slot 44 and slot 45, such that each slot tends to utilize a different longitudinal portion of drum assembly 22. In this way, over-use of any portion of the length of drum assembly 22 may be avoided, and the useful life of drum assembly 22 may be maximized.

While FIGS. 1-2 show slots 44, 45 provided on first side 40 of cover 34 and slot 47 provided on second side 42 of cover 34, it should be understood that according to various alternative embodiments, the relative positions of the various slots may be varied, and the size, number, and/or placement of slots may vary relative to the embodiment shown in FIGS. 1-2. For example, in some embodiments, each of first side 40 and second side 42 may include one, two, or more slots. Further, while in one embodiment multiple slots are spaced apart longitudinally along cover 34, in other embodiments, one or more slots may be spaced apart circumferentially about cover 34. Further yet, one or more slots on one or both sides of cover 34 may be equal in size and/or shape. In yet further embodiments, first side 40 or second side 42 may not have a slot. All such variations are to be understood to be within the scope of the present disclosure.

Referring further to FIGS. 1-2, in one embodiment, cover 34 may be integrally formed as part of housing 12 (e.g., via a molding, forming, or other process). In other embodiments, cover 34 may be a removable portion of housing 12 such that alternative covers (e.g., having different slot configurations) may be utilized (e.g., via a snap fit or other connection). Further, while FIGS. 1-2 generally show discreet first and second sides 40, 42 (e.g., divided by an intermediate raised portion), in other embodiments, first and second sides 40, 42 may connect to form a generally continuous cylindrical surface. All such variations are to be understood to be within the scope of the present disclosure.

Figure 12:
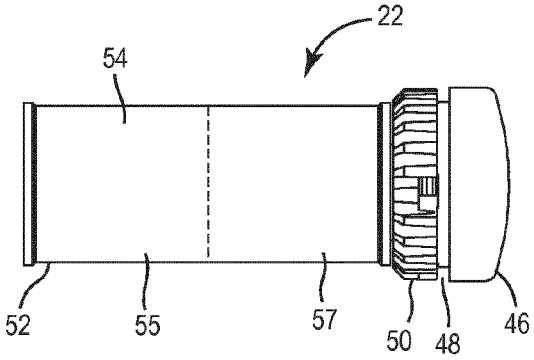
FIG. 12 is a side view of a drum assembly usable with the nail care device of FIG. 1 according to one embodiment.

Referring to FIG. 12, according to one embodiment, drum assembly 22 includes drum 52 (e.g., a roller, abrasive member, rotating member, etc.) and an end hub 46 coupled to a lateral end of drum 52. Drum 52 is the rotating element of drum assembly 22 and is rotatably coupled to hub 46. Drum 52 includes an abrasive outer surface 54 (e.g., an abrasive sheet of material such as sandpaper, an abrasive coating that may be sprayed or brushed, etc., and the like) configured to trim, remove or abrade nail material, skin material, etc. Hub 46 includes an annular groove 48 and a number of projections 50 that extend circumferentially about hub 46.

In one embodiment, drum 52 is compressible such that drum 52 is configured to deform (e.g., compress, deform, etc.) as a result of pressure applied to outer surface 54 (e.g., via a nail, skin, etc.). For example, should a user press a portion of a nail against outer surface 54, drum 52 may deform based on the amount of pressure applied. In some embodiments, a compressible drum provides enhanced control for trimming, shaping, and otherwise caring for nails, skin, etc. In alternative embodiments, drum 52 may be provided as a relatively hard, non-compressible drum.

Figure 11:
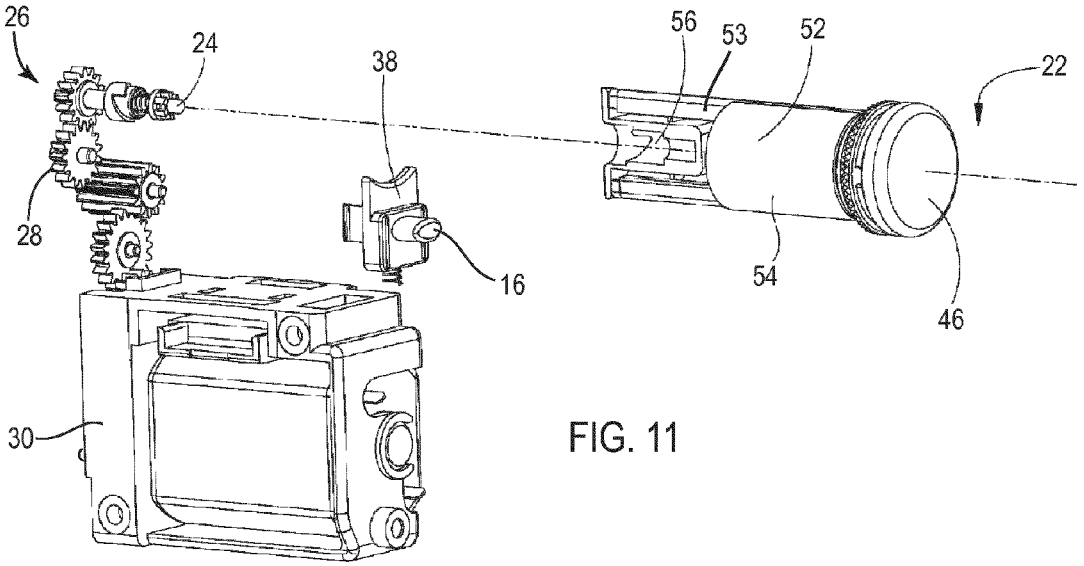
FIG. 11 is a perspective view of the drive system of FIG. 10 according to one embodiment.

Referring to FIG. 11, in one embodiment drum 52 includes a compressible core portion 53 provided beneath outer surface 54. In one embodiment, surface 54 may be a sheet of material adhered or otherwise secured to core portion 53. In other embodiments, outer surface 54 may be sprayed, brushed, or otherwise applied to core portion 53. In one embodiment, different portions of drum 52 may provide different levels of abrasiveness and/or hardness (e.g., along the length of drum 52). For example, a first longitudinal portion 55 of drum 52 may provide a first abrasiveness and/or harness, and a second longitudinal portion 57 of drum 52 may provide a second, different, abrasiveness and/or hardness. In some embodiments, the portions of differing harness and/or abrasiveness are generally aligned with one or more slots such as slots 44, 45, and 47. For example, with respect to slots 44 and 45, a first portion of drum 52 extending along slot 44 may provide a first hardness and/or abrasiveness, and a second portion of drum 52 extending along slot 45 may provide a second, different hardness and/or abrasiveness.

In one embodiment, drum assembly 22 further includes a drive recess 56 located on a lateral end of drum assembly 22 opposite from end hub 46. As discussed in further detail below, drive recess 56 is configured to engage a drive shaft 24 of device 10 to provide rotation of drum assembly 22.

Figure 8:
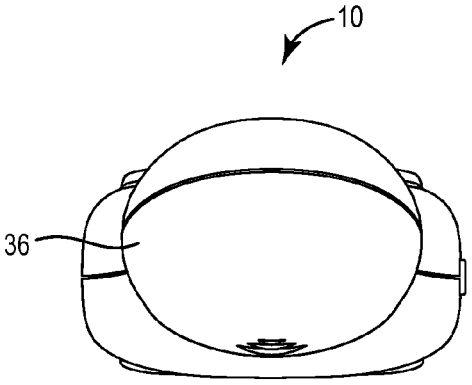
FIG. 8 is a bottom view of the nail care device of FIG. 1 according to one embodiment.
Figure 9:
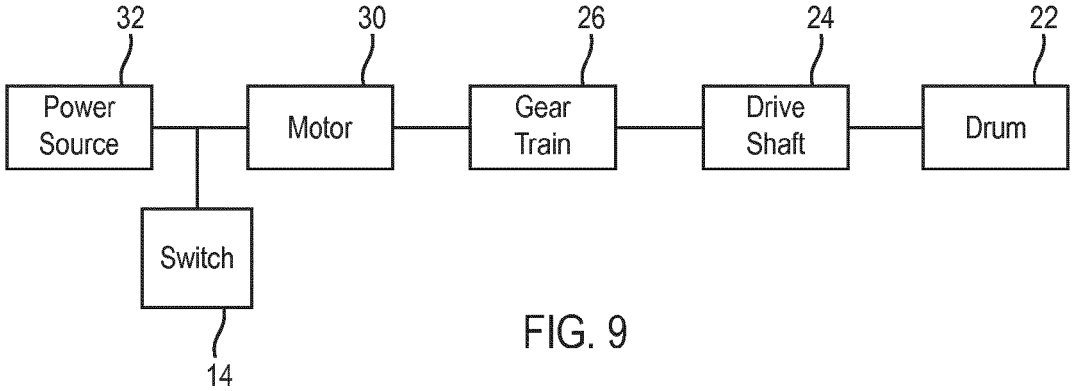
FIG. 9 is a schematic representation of a drive system for the nail care device of FIG. 1 according to one embodiment.

Referring to FIGS. 10-11, device 10 includes drive shaft 24 configured to receive drum assembly 22 such that rotation of drive shaft 24 causes a corresponding rotation of drum assembly 22. Drive shaft 24 is in one embodiment driven by an electric motor 30, and is operatively coupled to motor 30 by a gear train 26 including one or more gears 28. In other embodiments, other drive systems may be used, including belt-driven systems, and the like. As shown in FIG. 8, motor 30 receives power from power source 32. Power source 32 may be or include a removable and/or rechargeable battery, a power outlet configured to transfer power from an external power source, a non-removable, rechargeable battery, and the like. In one embodiment, drive shaft 24 extends into upper cavity 18, and all or portions of gear train 26, motor 30, and/or power source 32 are provided in lower cavity 20.

Drum assembly 22 may be inserted into and/or removed from upper cavity 18 via a lateral side of housing 12. As such, should drum assembly 22 become worn or unusable, or alternatively, should a user wish to utilize a drum assembly having different abrasiveness and/or hardness, the user may simply remove drum assembly 22 and replace it with a different drum assembly. Upon removal of drum assembly 22, drive shaft 24 remains within upper cavity 18 of device 10.

As shown in FIG. 12, hub 46 of drum assembly 22 includes projections 50 which engage housing 12 to maintain hub 46 rotationally fixed relative to housing 12. Support bracket 38 (e.g., a U-shaped support bracket) is received within annular groove 48 of hub 46 to fix the longitudinal position of drum assembly 22 within housing 12. To remove drum assembly 22, a user depresses release button 16 (e.g., in a downward direction), which moves support bracket 38 out from within annular groove 48, thereby allowing drum assembly 22 to be removed in a lateral direction. In some embodiments, drive recess 56 and drive shaft 24 engage in a spring-loaded fashion so that when release button 16 is depressed, drum assembly 22 tends to move laterally out of top cavity 18 (see FIG. 13).

Referring now to FIGS. 14-22, a nail care device 110 is shown according to one embodiment. Nail care device 110 operates in a manner similar to that of device 10 and includes similar components and features, with the exception that the shape of housing 112 differs from the shape of housing 12, and projections 150 of drum assembly 122 may be of a different configuration than projections 50 of device 10. More specifically, housing 112 provides a more compact device and a slightly different configuration for slots 144, 145, 147. Furthermore, the interface between the drum assembly and the housing may vary due to the differences of projections 50, 150.

Referring to FIGS. 14-15, cover 134 of housing 112 defines a plurality of slots 144, 145, 147. A first side 140 of cover 134 includes a single slot 144, and a second side 142 of cover 134 includes slots 145 and 147. Power button or switch 114 and release button 116 may be of similar construction and/or function as power button 14 and release switch 16 shown with respect to device 10.

In one embodiment, slots 145, 147 are longitudinally spaced apart from each other on second side 142, and slot 144 is positioned approximately longitudinally between slots 145 and 147 on first side 140. As shown in FIGS. 14-15, in one embodiment, slots 144, 145, and 147 may be of similar size and shape. In other embodiments, the size, shape, number, and position of any of slots may be varied.

In other respects, device 110 is substantially similar to device 10. For example, the devices may use a similar drive mechanism and use interchangeable rollers. Further, devices 10, 110 may be made out of similar materials and/or using similar processes. Device 110 provides a slightly smaller form factor, which may be beneficial in the case of persons with smaller hands, portability, etc.

Further modifications and alternative embodiments of various aspects of the embodiments disclosed herein will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A nail care device, comprising:

a housing defining an upper curved surface and first and second slots extending through the curved surface and to a cavity, wherein the first and second slots are spaced circumferentially about the upper curved surface of the housing;

a drive mechanism disposed within the housing and including a drive member extending into the cavity; and a drum assembly configured to be removably engaged with the drive member, the drum assembly including an abrasive drum having a curved abrasive surface and being configured to be received within the cavity and a hub configured to extend to an exterior of the cavity and the housing and remain coupled to the drum when the drum assembly is disengaged from the drive member;

wherein the drum assembly defines a longitudinal axis and wherein each of the first and second slots provides access to the curved abrasive surface and defines a length greater than a width and is elongated in a direction along the length and the longitudinal axis.

2. The nail care device of claim 1, wherein the abrasive drum is compressible during use by a user.

3. The nail care device of claim 1, wherein the abrasive drum includes a sheet of abrasive material provide over a compressible material.

4. The nail care device of claim 1, wherein the upper curved surface includes a curvature generally corresponding to a curvature of the abrasive drum.

5. The nail care device of claim 1, wherein the abrasive drum includes a first portion having a first abrasiveness and accessible via the first slot and a second portion having a second abrasiveness and accessible via the second slot.

6. The nail care device of claim 1, wherein when the drive mechanism rotates the abrasive drum, the hub remains rotationally fixed relative to the housing.

7. A portable nail care device configured for cordless handheld use, the nail care device comprising:

a housing including a housing wall defining:

an upper cylindrical exterior surface having first and second slots disposed therein, wherein the first and second slots are circumferentially spaced about the upper cylindrical exterior surface;

an interior, the interior including a lower cavity and an upper cavity;

a motor disposed in the lower cavity and coupled to a drive shaft extending into the upper cavity;

a drum assembly configured to be removably coupled to the drive shaft in the upper cavity, the drum assembly including a cylindrical drum including an abrasive outer surface and defining a longitudinal axis, and a hub coupled to the drum and extending beyond the housing wall, wherein the hub remains coupled to the drum when the drum assembly is removed from the housing;

wherein each of the first and second slots defines a length greater than a width and is elongated along the length in a direction parallel to the longitudinal axis.

8. The portable nail care device of claim 7, further comprising a hub assembly disposed at a first end of the cylindrical drum and extending beyond the housing wall to be accessible by a user to remove the cylindrical drum in a lateral direction along the longitudinal axis.

9. The portable nail care device of claim 8, wherein the hub assembly remains fixed relative to the housing when the cylindrical drum is rotated by the drive shaft.

10. The portable nail care device of claim 7, wherein the abrasive outer surface includes a sheet of abrasive material.

11. The portable nail care device of claim 7, wherein the first slot comprises a plurality of parallel slots spaced longitudinally relative to the drum assembly.

12. The portable nail care device of claim 7, wherein the first slot is disposed in a first side of the housing and the second slot is disposed in a second side of the housing opposite the first side.

13. The portable nail care device of claim 7, wherein the first slot is longitudinally spaced apart from the second slot.

14. The portable nail care device of claim 7, wherein the cylindrical drum comprises a first cylindrical portion having a first compressibility and a second cylindrical portion having a second compressibility different from the first compressibility.

15. A portable nail care device configured for cordless handheld use, the nail care device comprising:

a housing including a housing wall defining:

an upper cylindrical exterior surface having a plurality of slots disposed therein;

a lower exterior surface configured to be held in the hand of a user;

an interior, the interior including a lower cavity and an upper cavity;

a motor disposed in the lower cavity and coupled to a drive shaft extending into the upper cavity;

a drum assembly configured to be removably coupled to the drive shaft in the upper cavity, the drum assembly including:

a compressible cylindrical drum including an abrasive outer surface and defining a longitudinal axis;

a hub assembly disposed at a first end of the cylindrical drum and extending beyond the housing wall to accessible by a user to remove the cylindrical drum in a lateral direction along the longitudinal axis, wherein the hub remains coupled to the cylindrical drum when the drum assembly is decoupled from the drive shaft;

wherein each of the plurality of slots defines a length greater than a width and is elongated in a direction parallel to the longitudinal axis and along the length; and wherein the hub assembly remains fixed relative to the housing when the cylindrical drum is rotated by the drive shaft.

16. The portable nail care device of claim 15, wherein the cylindrical drum includes a recess extending along the longitudinal axis at a second end of the cylindrical drum, wherein the recess is configured to receive the drive shaft such that rotation of the drive shaft causes a corresponding rotation of the cylindrical drum while the hub assembly remains fixed relative to the housing.

17. The portable nail care device of claim 15, wherein the plurality of slots includes comprises first and second slots extending along and spaced apart in a direction parallel to the longitudinal axis.

* * * * *